United States Patent [19]

Schubert

[11] Patent Number: 4,969,225

[45] Date of Patent: Nov. 13, 1990

[54] BATHING AND CLEANSING ARTICLE

[75] Inventor: Zyfryd B. Schubert, Calimesa, Calif.

[73] Assignee: James B. Andres, Calimesa, Calif.

[21] Appl. No.: 443,085

[22] Filed: Nov. 28, 1989

Related U.S. Application Data

[63] Continuation-in-part of Ser. No. 212,234, Jun. 27, 1988, abandoned.

[51] Int. Cl.[5] ..... A47L 13/17

[52] U.S. Cl. ..... 15/209 C; 15/227; 51/400; 401/201

[58] Field of Search ..... 15/209 B, 209 C, 209 D, 15/227; 51/400; 401/201

[56] References Cited

U.S. PATENT DOCUMENTS

| | | | |
|---|---|---|---|
| 837,759 | 11/1906 | Weston . | |
| 1,397,611 | 11/1921 | Bailey . | |
| 1,748,406 | 2/1930 | Blair . | |
| 1,782,859 | 11/1930 | Perego . | |
| 1,909,966 | 5/1933 | Jones . | |
| 1,912,224 | 5/1933 | Schimel . | |
| 1,933,876 | 11/1933 | Smith . | |
| 1,975,451 | 10/1934 | Dunaway . | |
| 1,981,249 | 11/1934 | Rosenblatt . | |
| 2,032,762 | 3/1936 | Mitchell . | |
| 2,035,014 | 3/1936 | Schaefer . | |
| 2,083,871 | 6/1937 | Serewicz . | |
| 2,588,773 | 3/1952 | Smith . | |
| 2,958,885 | 1/1960 | Donney . | |
| 3,175,331 | 3/1965 | Klein | 401/201 |
| 4,510,641 | 4/1985 | Morris . | |
| 4,665,580 | 5/1987 | Morris | 401/201 X |
| 4,733,426 | 3/1988 | George . | |

FOREIGN PATENT DOCUMENTS

| | | | |
|---|---|---|---|
| 165348 | 7/1920 | United Kingdom | 401/201 |

*Primary Examiner*—Chris K. Moore

[57] ABSTRACT

This invention relates to bathing and cleansing articles, and more particularly, to improved scrub brushes specifically made to contain a bar of soap for use for bathing, cleansing, and the like.

7 Claims, 4 Drawing Sheets

BATHING AND CLEANSING ARTICLE

This is a continuation-in-part of application Ser. No. 07/212,234 filed Jun. 27, 1988, abandoned.

SUMMARY OF THE INVENTION

It has long been considered desirable to find a means of incorporating a bar of soap into a sponge or brush to facilitate bathing. Over the years many attempts have been made toward such an invention, but for one reason or another, either economical, practical, or aesthetic, heretofore all have met with failure. Early inventions were simply washcloths sewn into the shape of a pocket to contain the soap bar, and later, others tried slotting sponges. The basic problems encountered were that the materials used often retained so much water that the soap was quickly softened and wasted, or the sponge required a means of closure to contain the soap bar, thus exaggerating the first problem. As a result, many elaborate, expensive solutions were proposed.

This invention overcomes the disadvantages and problems of the prior art by the novel design of incorporating the unique qualities of an elastic, synthetic, fibrous batt, or chemical foam, with an unusual size and shape so as to eliminate the previous problems and disadvantages in a simple, economical way.

DESCRIPTION OF THE PREFERRED EMBODIMENT

This invention, in the preferred embodiment, is a scrub brush made of an elastic, resilient, synthetic, fibrous batt, or open-cell chemical foam, preferably polyurethane, formed into a desirable shape including an internal cavity or tunnel therein to contain a bar of soap or other solid cleansing substance. The cavity of the brush is necessarily smaller in cross-sectional area, or narrower than the typical size of the bar of soap, requiring the user to gently force the new bar of soap into the cavity of the scrub brush, thus slightly deforming the brush. Because of the batt's elastic, resilient quality, the batt rebounds, and thus tightly holds the new soap bar. When used, the outer surface of the soap bar softens slightly, resulting in the batt contracting further, and because of the batt's fibrous quality, embedding itself into the surface of the soap bar, resulting in a bond between the soap bar and the batt. Thus bonded, the soap bar becomes the internal backbone of the scrub brush, facilitating very easy handling for vigorous as well as gentle scrubbing, without the soap bar slipping out of the open cavity, and while also producing a rich lather.

IN THE DRAWING

Figure 1:
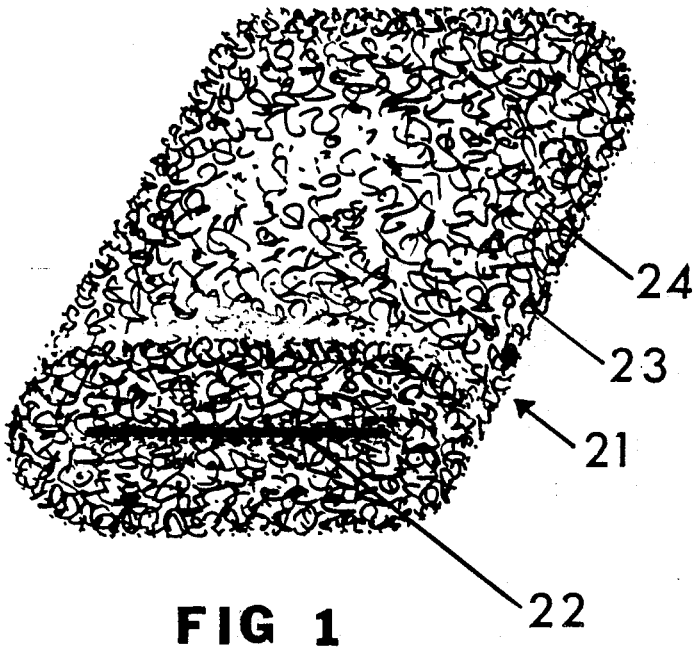
FIG. 1 is a perspective view of the scrub brush according to the invention.
Figure 2:
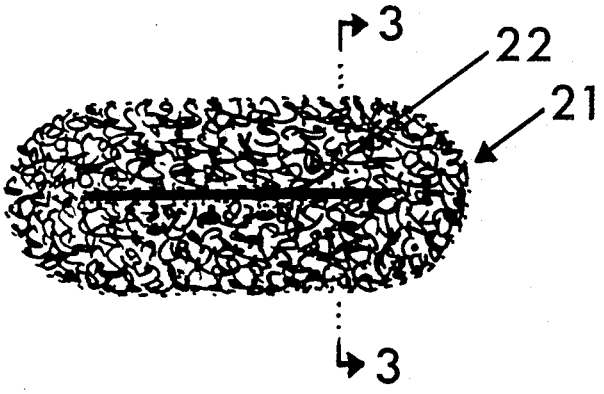
FIG. 2 is an end view of the scrub brush shown in FIG. 1.
Figure 3:
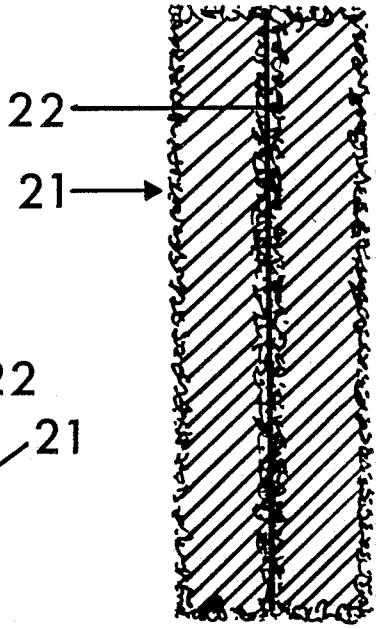
FIG. 3 is a cross-sectional view taken on line 3—3 of FIG. 2.
Figure 4:
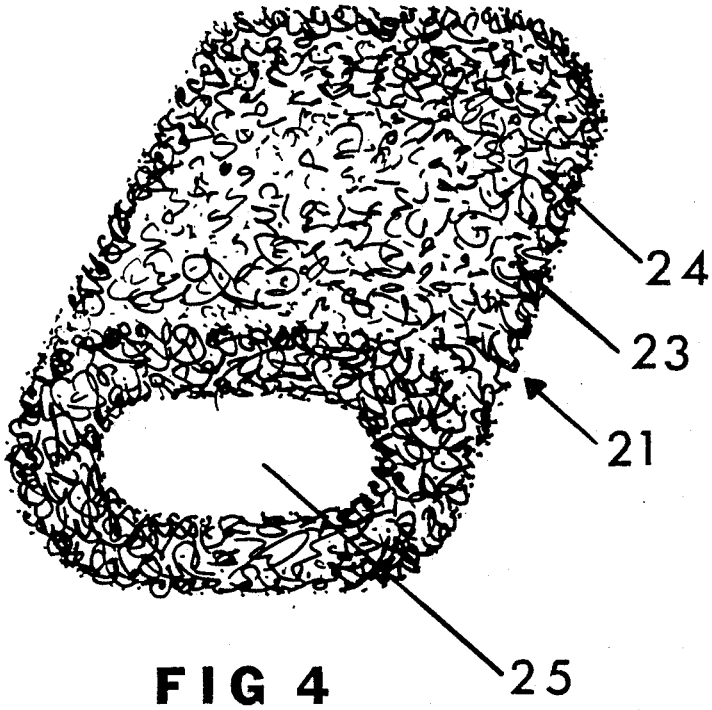
FIG. 4 is a perspective view of a scrub brush shown with a soap bar in the cavity.
Figure 5:
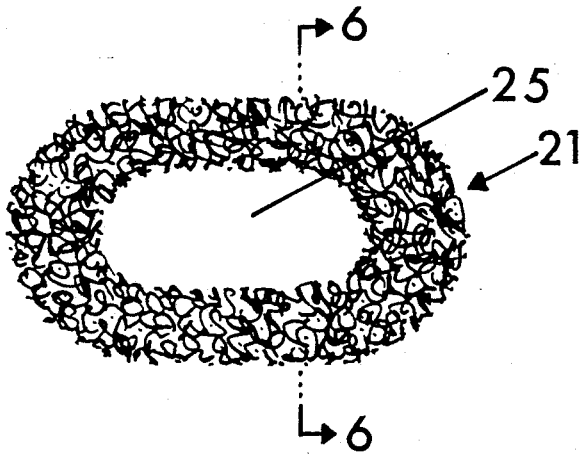
FIG. 5 is an end view of the scrub brush of FIG. 4.
Figure 6:
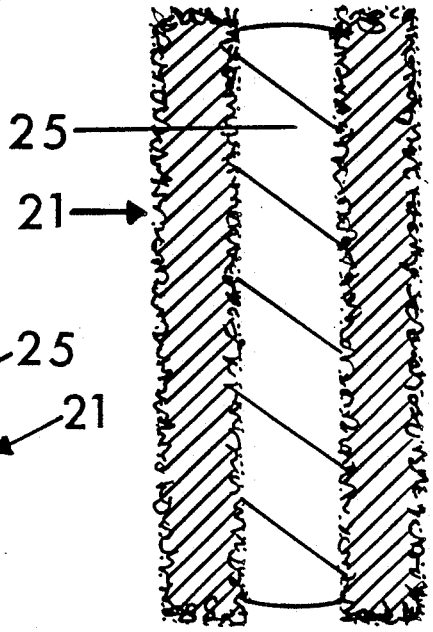
FIG. 6 is a cross-sectional view taken on line 6—6 of FIG. 5.

Now with more particular reference to the drawings, a scrub brush 21 is shown of a generally oval cylinder shape, approximate 4 inches long, 3 inches width and $1\frac{1}{4}$ inches high. The cavity 22 therein is cut in the shape of a wide slit approximately 2 inches wide. The fiber 23 of the batt is shown in its lofty three dimensional arrangement. The interconnecting voids 24 in the batt or foam surrounding the cavity 22 are somewhat random in shape, generally greater than 1/30th of an inch and less than $\frac{1}{3}$ of an inch in diameter to facilitate penetration of the fiber into the softened bar, and also to facilitate drainage of excess water. In FIG. 4, FIG. 5 and FIG. 6, the soap bar 25 is shown in the cavity 22 of the brush. Since the cavity has a smaller cross-sectional area than the soap bar, (or smaller cross-sectional perimeter), the soap bar 25 has expanded and deformed the brush and cavity to conform to the shape of the soap bar. The resulting tension on the soap bar holds the bar in place during use, and embeds the fibrous batt into the bar as it softens.

Figure 7:
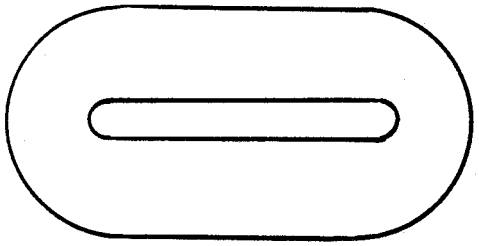
FIG. 7 is an end view of a scrub brush shown with a cavity in the shape of a wide oval.
Figure 8:
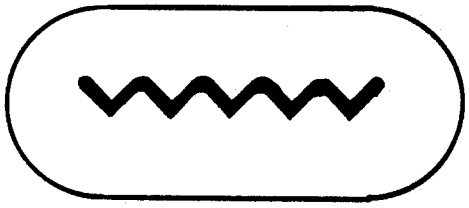
FIG. 8 is an end view of a scrub brush shown with a cavity cut in the shape of a zig zag pattern.
Figure 9:
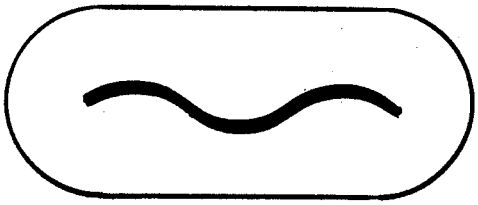
FIG. 9 is an end view of a scrub brush shown with a cavity cut in the shape of a wave pattern.
Figure 10:
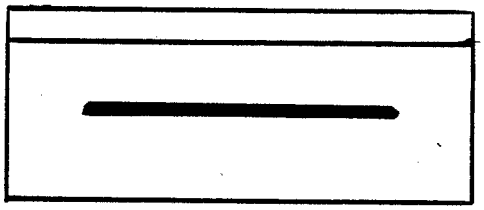
FIG. 10 is an end view of a scrub brush formed of two layers of dissimilar materials and-or textures.
Figure 11:
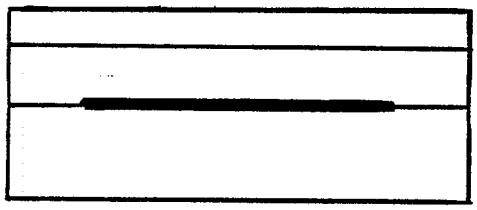
FIG. 11 is an end view of a scrub brush shown with multiple layers with a cavity formed by joining two layers together.
Figure 12:
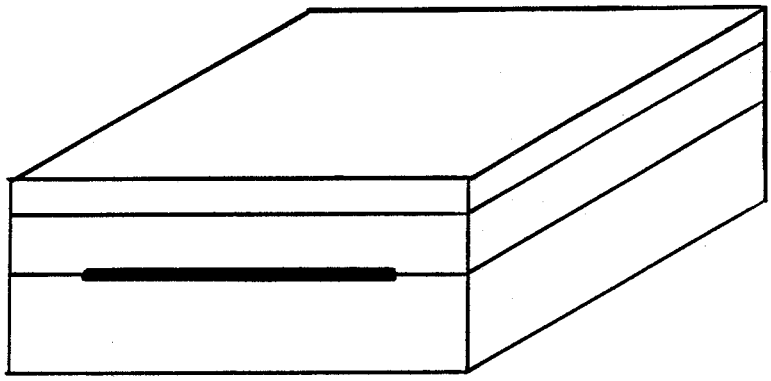
FIG. 12 is a perspective view of a scrub brush shown with multiple layers.

FIG. 7, FIG. 8, FIG. 9 are shown as a sample of the various possible types of cavities of the scrub brush. For the purpose of providing a scrub brush with multiple textures for gentle as well as abrasive scrubbing, the scrub brush of FIG. 10 is shown formed of two layers of dissimilar materials and-or textures (joined together with a suitable joining means) with the relatively coarse batt surrounding the cavity. In the interest of manufacturing simplicity, the scrub brush of FIG. 11 is shown formed of multiple layers (joined together with a suitable means), resulting in the cavity being formed in the shape of a flat cavity or pocket. The methods of joining or bonding the multiple layers of FIG. 9, FIG. 10, FIG. 11, and FIG. 12 could be flame bonding, or sonic welding, or other heat sealing means. They could be bonded together with adhesives, or they could even be sewn together.

It will be understood by one skilled in the art, that a scrub brush with such a configuration allows a great variety of shapes and sizes of different soap and detergent bars to be used without any special adaptation, though the size of the invention could be easily adapted to any particularly unusual size or specific soap bar. The special criteria of course is that the cavity be somewhat smaller in cross-sectional area, or cross-sectional perimeter, than that of the intended soap bar. Currently, the most widely used shape and size of detergent or soap bar is that of a rounded rectangular block approximately $2\frac{1}{4}$ inches wide, $3\frac{1}{2}$ inches long and 1 inch thick, with a cross-sectional area of about $2\frac{1}{4}$ square inches, and a cross-sectional perimeter of approximately $5\frac{3}{4}$ inches, though oval and other shapes of roughly the same volume are also popular. In practice, in order to sufficiently hold the soap bar, the cross-sectional area of a cavity could be between thirty-five and ninety-nine percent of the cross-sectional area of the soap bar, depending of course on the strength, elasticity and resiliency of the batt or foam, but it has been found that a figure of approximately seventy percent appears to be optimum. When the cavity is formed in the shape of a wide slit, the cross-sectional area of the cavity should be measured as the area of a shape similar to that of the bar where the length of the cross-sectional perimeter of the bar is equal to twice the length of the slit, or the proportion of the effective area of the cavity cut in the shape of a slit to that of the bar could be measured as a proportion of the cross sectional perimeter of the soap bar to that of the slit. For example, for a soap bar with a $5\frac{3}{4}$ inch cross-sectional perimeter, the optimum width of a cavity in the shape of a wide slit should be approximately:

$$5\tfrac{3}{4}\times 0.70\times 0.5=2 \text{ inches wide.}$$

In the case that the cavity is cut in the shape of an irregular slit such as FIG. 8 and FIG. 9, which would obviously have a greater cross-sectional perimeter than a cavity cut in the shape of a linear slit, the width of the cavity should still be measured as approximately the same as the overall linear width of the cut, because the effective area of both cavities would still be similar. It can readily be seen that many different shapes of cavity are possible, but the intent of shape and size of the cavity of the present invention, (in combination with the batt's fibrous quality), is to provide the brush with the ability to place a sufficient tension on the soap bar to hold the bar in an open cavity without the necessity of a means of closure for the cavity.

Furthermore, in the preferred embodiment, the scrub brush is made of an elastic, resilient, fibrous batt or reticulated chemical foam, strong enough to adequately accommodate the soap bar without tearing, with a sufficiently low density for bathing comfort, with cells large enough and with a minimal cell surface area to facilitate drainage of excess water, and with a structure fibrous enough to facilitate penetration into the softened soap bar to form a firm bond with the soap bar. It has been found that a thermally reticulated polyurethane open cell foam with an approximate density of 1.2 to 2.2 lbs per cubic foot, with an average cell size of approximately 15 pores per linear inch, (as measured in the industry), a tensile strength of approximately 10 psi and an ultimate elongation of approximately 100 percent is satisfactory, though different types of urethane foam have even greater strength and ultimate elongation. For bathing comfort, the greater the number of pores per linear inch, the softer the brush; But the fewer the number of pores per inch, the greater the penetration into the softened bar and the faster the drainage of excess water, which prevents soap waste. It appears that an average pore size of about 30 psi is the smallest practical pore size for a rapid drainage of excess water. It has also been found that a batt with an approximate cell size of 15 pores per linear inch appears to be the optimum size to satisfy both requirements, (for a brush formed of a single texture batt), but an even more desirable brush can be made by bonding such a batt to a much softer batt of about 40 to 80 psi on an opposite face of the brush for both vigorous and for more delicate cleansing. The resulting brush thus has two different textures, one on each of the two opposing faces.

In use, a person would grasp the edge of the batt or foam and gently force a bar of soap or detergent into the opening of the batt, thus forming the scrub brush; then wet, lather, and use as desired. Since the soap bar is accessible at the end of the cavity, a quick lather can be achieved by simply rubbing the end of the bar. With use, as the soap bar becomes smaller over time, a person simply needs to insert another bar into the cavity in a similar fashion. The new soap bar will bond to the old bar overnight, thus eliminating the need to handle small pieces of soap.

Though the preferred embodiment is generally a reticulated chemical foam batt in a rounded rectangular block shape with a wide, oval bore or slit for a cavity, in practice, the brush could be of any particular shape, such as a rectangular block with a slit with rounded ends, a round bore, or even a round tube. The brush could be constructed of multiple layers of similar or dissimilar chemical foam or fiber joined together with a suitable joining means. It could be constructed with a coarse batt of foam for excellent drainage surrounded by a finer one for bathing comfort. The batt could be made of a woven synthetic material, or surrounded by a netting of woven synthetic material. The brush could be made with grooves or cuts in the face for improved scrubbing action. The brush could be reversible. The cavity could be enclosed on all sides except one; and many other such variations will be obvious to one skilled in the art.

It will also be obvious that the scrub brush described should not be restricted only for use as a bathing article, for with the proper cleansing or scouring substance, the brush will work efficiently as an all purpose cleansing article. In such a cleansing article, the batt could be constructed of a reticulated chemical foam, or of a body of nonwoven, synthetic fibers arranged in a lofty three dimensional random arrangement and bonded together at their intersections to form a plurality of interconnecting voids, (as is common in the industry), resulting in a batt with somewhat similar properties to that of a batt of reticulated chemical foam.

Although it being understood that changes may be made in the form, size, proportions, and minor details of construction without departing from the spirit or sacrificing any of the advantages of the invention,

I claim:

1. A scrub brush comprising: a body of nonwoven, synthetic fibers; said fiber arranged in a lofty three-dimensional random arrangement and bonded together to form a plurality of interconnecting voids; said body formed to include an internal cavity open at least at one end therein to contain a bar of soap; said cavity being less in cross-sectional area than said bar so that said body of fibers must be deformed to accommodate said bar; said body of fibers being sufficiently elastic and resilient enough to rebound and firmly hold said bar, and to embed itself into said bar as it softens; said voids being large enough to facilitate drainage of excess water.

2. A scrub brush comprising: a body of reticulated chemical foam formed to include an internal cavity open at least at one end therein to contain a bar of soap; said cavity being less in cross-sectional area than said bar so that said body must be deformed to accommodate said bar; said body of fibers being sufficiently elastic and resilient enough to rebound and firmly hold said bar, and fibrous enough to embed itself into said bar as it softens; the pores of said foam being large enough to facilitate drainage of excess water.

3. A scrub according to claim 2: wherein said body of foam is formed of a plurality of individual layers joined together by a suitable joining means.

4. A scrub brush according to claim 3: wherein said cavity is formed by joining said layers together with said suitable joining means.

5. A scrub brush comprising: a body of reticulated chemical foam formed to include an internal cavity open at least at one end therein to contain a bar of soap; said cavity being formed into a shape wherein said body of foam must be deformed to accommodate said bar; said body of foam being sufficiently elastic, resilient, and fibrous enough to rebound and firmly hold said bar in said cavity without a means of closure for said cavity.

6. A scrub brush according to claim 2: wherein said chemical foam has a density of 1.0 to 3.0 lbs/cubic foot; an average cell size between 5 and 35 pores per linear inch; a tensile strength of at least 5 psi; and an ultimate elongation of at least 50 percent.

7. A scrub brush according to claim 2: wherein said cavity is formed in the shape of a wide slit whose cross-sectional perimeter is less than that of said bar.

* * * * *

UNITED STATES PATENT AND TRADEMARK OFFICE

CERTIFICATE OF CORRECTION

PATENT NO. : 4,969,225
DATED : November 13, 1990
INVENTOR(S) : Zyfryd Bertan Schubert

It is certified that error in the above-identified patent and that said Letters Patent is hereby corrected as shown below:

| | | |
|---|---|---|
| Col 2, line 14 | delete "approximate" | insert --approximately-- |
| Col 2, line 14 | delete "width" | insert --wide-- |
| Col 3, line 7 | delete "," | insert --;-- |
| Col 3, line 53 | delete "psi" | insert --ppi-- |
| Col 4, line 44 | delete "fiber" | insert --fibers-- |
| Col 4, line 61 | delete "fibers" | insert --foam-- |
| Col 4, line 66 | after "scrub" | insert --brush-- |

Signed and Sealed this

Twenty-eighth Day of April, 1992

*Attest:*

*Attesting Officer*

HARRY F. MANBECK, JR.

*Commissioner of Patents and Trademarks*